US005754999A

United States Patent [19]

Helmsderfer

[11] Patent Number: 5,754,999

[45] Date of Patent: May 26, 1998

[54] BABY DIAPER CHANGING STATION

[76] Inventor: John A. Helmsderfer, 2151 Luray Ave., Cincinnati, Ohio 45206

[21] Appl. No.: 730,373

[22] Filed: Oct. 15, 1996

[51] Int. Cl.[6] ..... A47C 17/40; A47D 7/00

[52] U.S. Cl. ..... 5/655; 5/947; 5/136; 108/38; 108/42; 312/248

[58] Field of Search ..... 5/655, 133, 136, 5/947, 424; 312/248, 242, 246; 108/42, 38

[56] References Cited

U.S. PATENT DOCUMENTS

| | | | |
|---|---|---|---|
| D. 179,871 | 3/1957 | Wrablica, Jr. . | |
| D. 243,048 | 1/1977 | Touchett et al. | D6/132 |
| D. 243,213 | 2/1977 | Kormos | D6/14 |
| D. 246,682 | 12/1977 | Nakao | D6/7 |
| D. 248,805 | 8/1978 | Bridges | D6/136 |
| D. 249,991 | 10/1978 | Bridges | D6/136 |
| D. 250,800 | 1/1979 | Trossman | D6/132 |
| D. 251,039 | 2/1979 | Reppas | D6/4 |
| D. 255,734 | 7/1980 | Liebman | D6/136 |
| D. 260,827 | 9/1981 | Sommer | D6/80 |
| D. 263,532 | 3/1982 | Ferdinand et al. | D6/178 |
| D. 265,703 | 8/1982 | Zaro | D6/199 |
| D. 267,843 | 2/1983 | Sundberg | D6/132 |
| D. 272,402 | 1/1984 | Marrujo | D6/199 |
| D. 274,105 | 6/1984 | Brescia et al. | D6/114 |
| D. 277,819 | 3/1985 | Crosslen | D6/449 |
| D. 283,189 | 4/1986 | Hampton | D6/574 |
| D. 284,530 | 7/1986 | Riehm | D6/384 |
| D. 284,531 | 7/1986 | Riehm | D6/384 |
| D. 284,723 | 7/1986 | Morris et al. | D6/650 |
| D. 287,200 | 12/1986 | Gecchelin | D6/574 |
| D. 287,318 | 12/1986 | Garduno | D6/392 |
| D. 293,403 | 12/1987 | Umanoff et al. | D6/555 |
| D. 293,404 | 12/1987 | Murphy | D6/574 |
| D. 294,096 | 2/1988 | Murphy | D6/560 |
| D. 295,007 | 4/1988 | Hardy et al. | D6/555 |
| D. 299,687 | 2/1989 | Handler et al. | D6/574 |
| D. 312,185 | 11/1990 | Prater, Sr. | D6/574 |
| D. 313,516 | 1/1991 | Socher | D6/384 |
| D. 314,112 | 1/1991 | Dainty | D6/555 |
| D. 314,486 | 2/1991 | Day | D6/555 |
| D. 318,307 | 7/1991 | Hahn et al. | D21/12 |
| D. 322,531 | 12/1991 | Hobson | D6/574 |
| D. 325,309 | 4/1992 | Worrell | D6/509 |
| D. 325,826 | 5/1992 | Brunner et al. | D6/397 |
| D. 326,384 | 5/1992 | Burt et al. | D6/555 |
| D. 327,786 | 7/1992 | Ferrell | D6/397 |
| D. 332,197 | 1/1993 | Chase | D6/555 |
| D. 333,389 | 2/1993 | Saito et al. | D6/356 |
| D. 333,923 | 3/1993 | Dainty | D6/333 |
| D. 336,192 | 6/1993 | Wedeking | D6/511 |
| D. 344,869 | 3/1994 | Paradis et al. | D6/555 |
| 2,174,363 | 9/1939 | Eubank . | |
| 2,735,737 | 2/1956 | Hancock | 5/947 |
| 3,620,404 | 11/1971 | Grasso | 362/242 |
| 3,656,193 | 4/1972 | Schneider et al. | 5/655 |
| 3,693,293 | 9/1972 | Egan, Jr. et al. | 49/56 |

(List continued on next page.)

FOREIGN PATENT DOCUMENTS

| | | | |
|---|---|---|---|
| 1515114 | 1/1968 | France | 5/947 |
| 1101928 | 4/1989 | Japan | 5/947 |

*Primary Examiner*—Alexander Grosz
*Attorney, Agent, or Firm*—Wood, Herron & Evans LLP

[57] ABSTRACT

A baby diaper changing station comprises a base and a support platform hingedly mounted at one side to the base and a rail structure on at least one side of the platform to increase the effective depth of the platform. A utility channel surrounds the platform for holding various diaper changing supplies and removable protective panels are positioned on bottom and side surfaces of the platform to reduce vandalism damage. A waste chute is formed in the base or support platform of the diaper changing station and cooperates with a waste receptacle proximate the station for receiving used diapers and other related waste. Accessory hooks on the platform are configured to receive and hold diaper changing supplies, such as a diaper bag. An alternative embodiment of the diaper changing station utilizes a platform having nested sections which telescope to increase the effective depth of the platform.

14 Claims, 2 Drawing Sheets

U.S. PATENT DOCUMENTS

| | | | |
|---|---|---|---|
| 4,074,635 | 2/1978 | Stauble | 108/27 |
| 4,125,192 | 11/1978 | Dayen | 211/14 |
| 4,133,063 | 1/1979 | Jones-Steele | 5/99.1 |
| 4,205,669 | 6/1980 | Hamann | 5/424 |
| 4,216,951 | 8/1980 | Griffin | 108/134 |
| 4,522,381 | 6/1985 | Ludwick | 5/655 |
| 4,527,830 | 7/1985 | Meyers | 297/192 |
| 4,613,996 | 9/1986 | Chase et al. | 5/136 |
| 4,633,789 | 1/1987 | Kortering et al. | 108/152 |
| 4,648,766 | 3/1987 | Wollar | 411/41 |
| 4,712,258 | 12/1987 | Eves | 5/655 |
| 4,723,493 | 2/1988 | Siani et al. | 5/947 |
| 4,788,726 | 12/1988 | Rafalko | 5/424 |
| 4,796,314 | 1/1989 | Garduno | 5/98.1 |
| 4,876,970 | 10/1989 | Bolduc | 5/947 |
| 4,953,312 | 9/1990 | Astolfi | 40/156 |
| 4,965,896 | 10/1990 | Berger et al. | 5/947 |
| 4,972,532 | 11/1990 | Juan | 5/94 |
| 4,978,093 | 12/1990 | Kennedy | 248/304 |
| 5,072,979 | 12/1991 | Swinton | 293/128 |
| 5,081,724 | 1/1992 | Takahashi et al. | 5/947 |
| 5,084,927 | 2/1992 | Parkevich | 5/484 |
| 5,086,527 | 2/1992 | Takahashi et al. | 5/136 |
| 5,161,270 | 11/1992 | Najmabadi | 5/655 |
| 5,265,296 | 11/1993 | Abbas et al. | 5/612 |

BABY DIAPER CHANGING STATION

FIELD OF THE INVENTION

The present invention relates to an apparatus to be placed in a restroom for changing the diapers of an infant.

BACKGROUND OF THE INVENTION

Apparatuses for changing the diapers of a baby or "changing a baby", and other small children not yet toilet trained, have become widely used, such as in public restrooms, to assist a parent or other child supervisor when changing a baby's diapers. Such baby diaper changing apparatuses, often times referred to as simply baby changing stations, have taken various forms as evidenced by patents in the field, and are generally mounted onto a horizontal wall surface. A support platform is hingedly mounted to move down from the wall surface and lie generally horizontal to support a baby thereon. While available baby changing stations may operate sufficiently for the primary purpose of offering a generally horizontal surface on which to rest a baby during a diaper change, the currently available stations often do not adequately address the desires of the facility owners who must install them or the requirements of the person using them.

For example, one drawback to existing baby changing stations is the fact that most such stations are fabricated of molded plastic in a single neutral color. This is not a desirable feature of the stations for facilities owners since the stations present a large, unattractive structure on the wall of the restroom facility. Contractors, architects and the owners of many public facilities go to great lengths to present a clean and efficient restroom area with a pleasing design and color scheme. However, existing baby changing stations detract from the overall restroom decor because their large, neutral exposed surfaces clash with other colors within the restroom area. Furthermore, since the off-color baby changing apparatuses are mounted to a wall, they are particularly noticeable, further detracting from the decor. When the supporting platform is in an up and closed position, the large amount of exposed surface area against the wall of the restroom presents a distinct clash with the colors of other restroom apparatuses and surfaces. Therefore, it is an objective of the present invention to present an improved decorative impression within a public restroom facility utilizing a baby changing apparatus.

Molded plastic stations are also rather subject to vandalism since the plastic is easy to cut into or to permanently mark with a pen or paint. Plastic stations also are particularly susceptible to wear in frequent use environments, such as amusement parks. Therefore, it is another objective to provide a changing station which is less susceptible to vandalism and is able to adequately withstand heavy use.

The existing plastic stations may also project an image of uncleanliness, since molded plastic surfaces are sometimes difficult to clean. Because of structural and molding requirements, plastic stations have plastic that is porous and contains a number of grooves and/or pits. Dirt may become trapped in these small grooves or pits in the plastic and may become very difficult to remove, leaving stains or marks on the station. Plastic is usually not used with a number of traditional restroom fixtures. Rather, ceramic and metal are traditionally used and are readily wiped clean and disinfected. Such materials have heretofore been difficult to utilize in making changing stations. Additionally, the weight of such structures would need to be considered. Furthermore, resting a baby on surfaces formed of those materials might cause discomfort due to the cold feeling on the baby's exposed skin if the station is not warmed. It is, therefore, another objective of the invention to present a changing station which projects a more positive image of a sterile environment which is clean and germ-free. However, it is also an objective to maintain the comfort of a baby on the station.

An additional drawback in some changing stations is the difficulty in closing the support platform once the diaper changing procedure are complete. As may be appreciated, a person closing the station will generally be holding a baby, diaper supplies and possibly a coat. Therefore, they cannot devote a large amount of strength to closing the station. It is, therefore, still another objective of the invention to assist a person in closing the station up against the wall when they are finished using it.

Strength is also a desirable characteristic of a diaper changing stations to ensure the safety of the baby even after vandalism or other inappropriate use, and therefore, it is an objective to maintain the strength of the station while ensuring easy manipulation.

It is also desirable to provide a changing station that may be mounted in a number of different ways. Most changing stations are surface mounted to a wall surface and project outwardly into the restroom. To provide compliance with ADA regulations while enhancing appearance and resisting vandalism, it may be desirable to partially inset a portion of the changing station into the wall to decrease its effective outwardly projected dimension. However, surface mounting may be the only alternative, and therefore, it is a further objective of the invention to be able to alternatively surface mount or inset the changing stations while still maintaining the aesthetic appearance thereof in the restroom facility and without modifying the changing station substantially.

All of the above-stated objectives must be accomplished while meeting specific construction codes and regulations pertaining to baby changing stations and other restroom fixtures. As discussed, the Americans With Disability Act (ADA) states that the projection depth from the wall of a baby changing stations must be four inches or less. Therefore, it is a further objective to provide a baby changing station which addresses the aforementioned objectives while meeting current regulations.

SUMMARY OF THE INVENTION

The above-discussed objections and other objectives are achieved by the baby diaper changing station of the present invention which provides a clean and aesthetically pleasing station which assists a person in changing a baby and increases the convenience and efficiency of the changing procedure as well as providing safe support for the baby. The baby changing station of the invention provides a sanitary structure while keeping a baby placed thereon generally warm and unexposed to cold surfaces. The owner of the facility is also provided with a changing station which coordinates with the appearance of the restroom facility, while providing substantial durability and resistance to vandalism.

The baby diaper changing station is mounted on a wall and comprises a base structure which is configured to be surface mounted to the wall or inset therein. To that end, the base structure of one embodiment is formed of stainless steel and includes a bottom wall and a side wall extending peripherally therearound, generally perpendicular to the bottom wall to be inset into a wall surface. The station further comprises a peripheral collar positioned around a forward edge of the side wall and operable for engaging a wall surface when the base structure is inset therein. Thereby, the depth of penetration of the base structure into the wall surface is limited when inset. The collar generally does not effect the station when it is surface mounted.

The station further comprises a shroud configured to be coupled to the base structure to cover an outer portion of the structure. The shroud is generally rectangular and includes at least three perpendicular sides. The shroud fits over the base structure to cover the top portion and side portions of the base side wall. The bottom portion which is not generally in view of an adult is not covered. The shroud is dimensioned to extend between the base bottom wall and collar, and it stands off from the base side wall to increase the effective peripheral side wall dimension of the base. In that way, the shroud reduces the distance which the collar stands off of the side wall and when the station is surface mounted, it appears to have been constructed for surface mounting. If the shroud is then removed, the station may be inset in a wall. Therefore, the station projects the proper aesthetic appearance whether it is surface mounted or inset.

A support platform is hingedly coupled to the base structure at defined hinge axis and is movable alternatively between open and closed positions. The support platform is formed of stainless steel and includes a bottom wall and a peripheral side wall. The station is configured to define a trough for receiving a baby placed on the platform when in the open position. Preferably, the base structure is configured generally larger than the support platform around its outer periphery to receive the platform such that the base structure and support platform nest together when the platform is in the closed position. The stainless steel construction of the support platform and base structure eliminates the molded plastic surfaces generally used in the art. Therefore, the station of the present invention provides a sanitary surface which may be easily cleaned and maintained and is less subject to permanent graffiti and structural damage. The station is very durable and is able to withstand a substantial amount of use in a heavy traffic application. Furthermore, the stainless steel construction creates a unique aesthetic within a restroom which does not detract from the decor of the restroom, but rather enhances that decor. The steel color does not clash with other restroom colors, but appears as a clean fixture much the same way that metal waste receptacles, towel dispensers, faucets or flush valves might appear in a restroom.

Within the trough defined by the support platform, an insulative bed formed of a hard plastic material is positioned for supporting a baby placed therein. The insulative bed of plastic materials maintains the surface of the baby out of contact with the stainless steel support platform during changing of the baby diapers to generally keep the baby from being chilled by the stainless steel platform. Thus, while the station of the invention provides a sanitary and easily cleaned environment, the well-being of the baby is maintained by eliminating any discomfort associated with a cold stainless steel surface. Preferably, the insulative bed includes a cylindrically curved portion disposed along the length of the bed for receiving and containing a baby placed thereon. At least one utility tray indentation is formed in the upper surface of the bed for receiving and containing items used to change a baby diapers, such as baby wipes, powder, lotions or a diaper. The peripheral side wall of the support platform has hook structures formed therein to support the straps of a purse or diaper bag and keep the item away from the restroom floor. In that way, the parent or caregiver does not have to place the purse or bag next to the baby.

The station of the invention provides enhanced securement of the support platform for the safety of a baby placed thereon. More specifically, the base structure comprises a securing lip which extends forwardly thereof when the base structure mounted to a wall, generally co-planar with the wall and vertically disposed. A rear edge of the support platform is positioned proximate the base structure when the support platform is in an opened position. The lip is operable for catching a portion of the support platform rear edge when the platform is opened to thereby secure the platform in the opened position. The stainless steel construction of the support platform and the base structure and the operation of the lip provides strong support to maintain the support platform generally horizontal under a substantial weight load.

To assist a caregiver in closing the support platform when the baby diaper changing procedure is complete, the invention comprises a pressurized cylinder coupled between the support platform and the base structure. The cylinder is anchored at one end thereof to the base structure and is anchored at the other end to a point on the support platform. The anchor point on the support platform is located rearwardly of the hinge axis of the support platform. The cylinder has a steady state or rest length and includes a piston arm which is operably extended when the station is closed. When the platform is hinged away from the base structure and moved to the open position, the cylinder provides a damping of the platform movement to prevent the platform from slamming into the opened position. During a range of hinge movement of the support platform, the cylinder piston passes through its steady state location and is compressed into a cylinder body as the platform moves to the fully opened position to lie generally horizontal. Thereby, the cylinder directs a biasing force on the support platform at its anchor point. Since the platform anchor point is located rearwardly of the hinge axis, the cylinder biasing force on the point biases the support platform to hinge it towards the closed position. In that way, the cylinder provides damping when the support platform is opened, and once opened, provides a closing force thereon to facilitate closing of the platform once the diaper change is completed. As may be appreciated, the closing force is a significant advantage to a person who may have their arms full with a baby, changing supplies and any other implements which they are carrying.

The above and other objects and advantages of the present invention shall be made apparent from the accompanying drawings and the description thereof.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
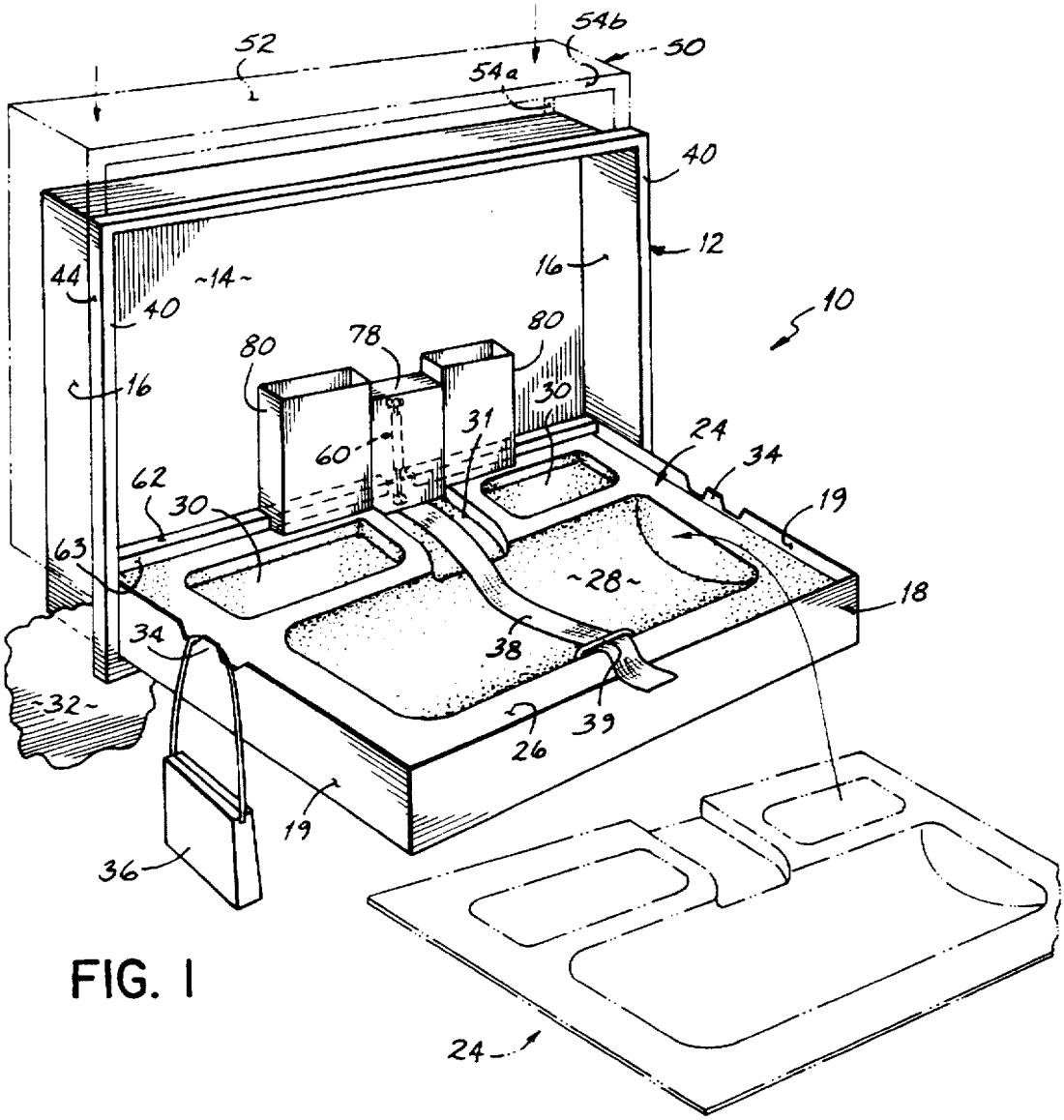
FIG. 1 is an exploded perspective view of a baby diaper changing station in accordance with the principles of the present invention.

FIG. 1 shows a baby diaper changing station 10 constructed in accordance with the principles of the present invention. Station 10 comprises a base structure 12 which includes a back or bottom wall 14 and a peripheral side wall 16 surrounding the periphery of the bottom wall. A support platform 18 is hingedly coupled to the base structure 12 by appropriate bolts or other fasteners (see FIGS. 3A, 3B). Furthermore, a solid hinge extending the length of the support platform might also be used. The hinge structure utilized generally extends through the side wall 16 of the base structure and into a side wall 19 of support platform 18 to define a hinge axis 20 (see FIGS. 3A, 3B).

The support platform includes a forward or bottom wall 21 surrounded by a peripheral side wall 19 to define a trough 23 to receive a baby placed on the support platform.

The base structure 12 and support platform 18 are both formed of stainless steel, such as 304 stainless steel. The stainless steel construction, in the station 10 of the invention, provides a strong construction which will safely support the weight of a baby thereon. The stainless steel will not rust in the often-damp environment of a restroom facility and provides a surface which may be easily cleaned and disinfected to give the diaper changing station 10 a sterile and pleasing appearance. This is particularly important to the care provider of a baby who will not want to change diapers on a structure which looks to be germ ridden or dirty.

Furthermore, the stainless steel construction of station 10 of the invention is resistant to damage such as graffiti or more physical damage. The molded plastic construction of existing changing stations is susceptible to being marred or cut into with a sharp implement such as a knife. Changing station 10 is less susceptible to being gouged or cut into. Furthermore, ink and paint used for graffiti will generally wipe clean and will not stain the stainless steel as it would molded plastic.

While the stainless steel construction offers a number of distinct advantages, the inventor has determined that such a structure might be too cold for the exposed skin of a baby. Stainless steel, like any metal, is a good conductor of heat and has a high capacity for heat absorption. Therefore, even in a warm restroom, the ambient temperature stainless steel surface would be cold and chilling to the touch.

To prevent child discomfort, changing station 10 of the invention further comprises an insulative surface 24 formed of a plastic material such as ABS or Polystyrene. The insulative surface is formed preferably in the shape of a bed which is configured to fit inside of the trough 23 defined by the bottom wall 21 and the side walls 19 of the support platform 18. Insulative bed 24 receives a baby placed on the support platform and is operable to maintain an exposed skin surface of the baby out of contact with the stainless steel of support platform 18. In that way, during the changing of the baby's diapers, the baby is generally kept from being chilled by the stainless steel which may be startling for the baby. The plastic bed is formed to provide a smooth, gap-free surface for easier cleaning. The smooth surface resists the accumulation of dirt and other contaminants on the bed.

Insulative surface or bed 24 preferably is removable from the platform 18 and includes a flattened peripheral flange portion 26 which surrounds the insulative bed. The flange portion 26 engages a shelf 27 formed around the side wall 19 of support platform 18. Thereby, the bed 24 is supported within the trough of the support platform 18 and is disposed in a generally horizontal orientation like the support platform. Bed 24 includes a cylindrically curved portion 28 disposed generally along the length of the bed 24 for receiving and containing a baby placed on the bed. The cylindrically curved shape of portion 28 allows side-to-side rolling of the baby, but maintains the baby within the bed 24. Bed 24 further includes utility trays 30 formed therein for holding implements used in the diaper changing process, such as extra diapers, baby wipes, powder, lotion or other items.

An indentation 31 is provided in bed 24 to provide clearance for a cylinder which aids in the opening and closing of the stations as discussed further hereinbelow.

Figure 2:
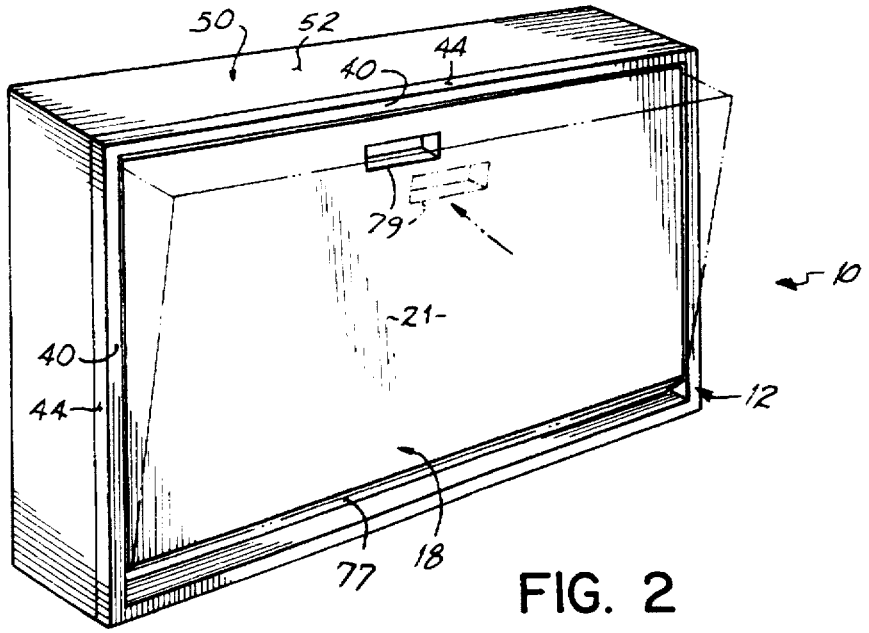
FIG. 2 is a perspective view of the baby diaper changing station of the invention moved toward the closed position and surface mounted on a wall

As illustrated in FIGS. 1 and 2, the support platform 18 is preferably configured in dimension with respect to base structure 12 such that the support platform 18 nests within the base structure 12. As illustrated in FIG. 1, the support platform 18 in the opened position, extends generally horizontal and perpendicular to the base structure 12 which is mounted to a wall surface 32.

Referring to FIG. 2, the support platform 18 may be hinged upwardly to the closed position to nest within base structure 12 such that only the front wall 21 of the support platform is exposed. In that way, a support platform 18 with a sufficient depth may be utilized for safe support of a baby while meeting the spatial requirements of the ADA, i.e., a spacing of four inches or less from the wall.

As illustrated in FIG. 1, the side wall 19 includes a pair of utility hooks 34 formed therein which are used for holding an accessory such as a diaper bag or purse 36. In that way, the bag or purse is not placed upon a restroom floor which may be dirty. Also, the purse or bag 36 does not have to placed on the bed 24 which will be somewhat crowded with the baby thereon. Support platform 18 further includes a safety strap 38 which is connected to either base structure 12 or one side of support platform 18 by means not shown, and is threaded through a clasp or buckle 39 where is it overlapped or attached, such as with hook and loop fasteners, snaps or other securing structures.

Figure 3A:
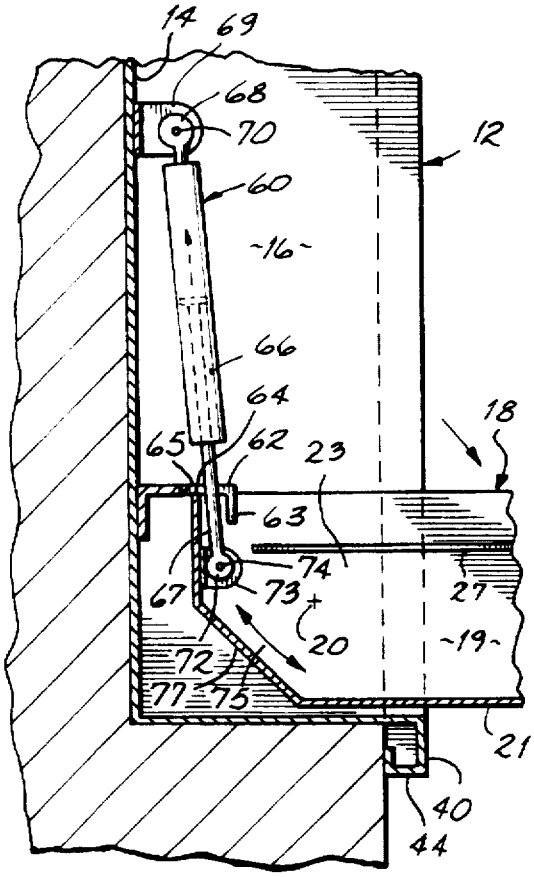
FIG. 3A is a side view, in partial section, of a baby diaper changing station in accordance with the principles of the invention mounted inset into a wall and moved to the open position.
Figure 3B:
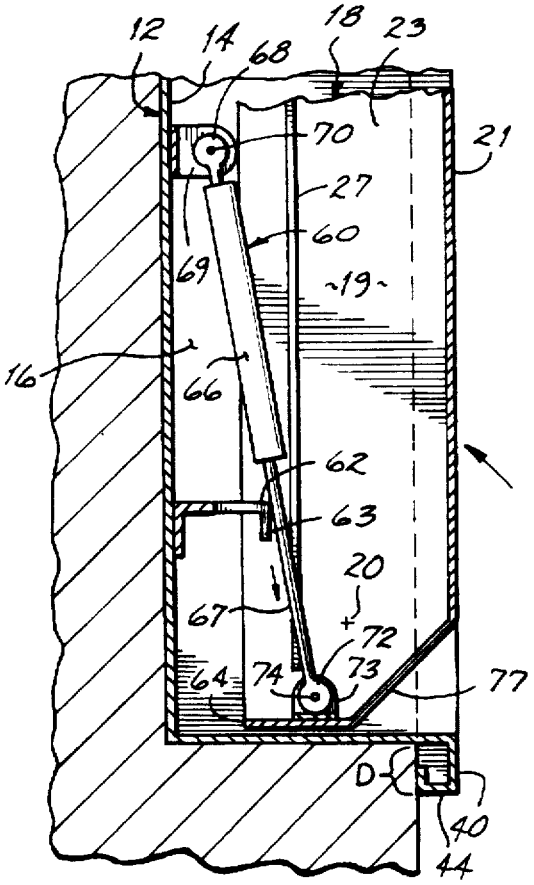
FIG. 3B is a cross-sectional view similar to FIG. 3A showing the baby diaper changing station moved to the closed position.

Station 10, in accordance with the principles of the present invention, may either be surface mounted to a wall surface 32 or inset into the wall surface 32. To that end, a peripheral collar structure 40 is attached to side wall 16 and positioned around a forward or upper edge spaced from bottom wall 14. That is, the collar structure 40 is positioned around the forwardmost edge of the base structure 12 when the base structure is mounted to wall surface 32. As illustrated in FIGS. 3A, 3B, the collar structure 40 abuts against the wall surface 32 to provide a controlled depth setting when the station 10 is inset in the wall. However, when the station is surface mounted as is shown in FIG. 1, the distance D between the side wall 16 and the outer edge 44 of collar structure 40 gives the surface mounted station 10 the aesthetic look of an inset structure which has been improperly surface mounted.

To provide a more aesthetically pleasing look to the surface mounted station, the invention further comprises a shroud 50 which is placed around the side wall 16 of the base structure 12 to effectively increase the outer peripheral dimension of the base structure with respect to collar structure 40. The shroud 50 is rectangular and includes perpendicular wall portions 52 which are generally configured to overly the side and top sections of the side wall 16 as illustrated in FIG. 1. Shroud 50 slides over side wall 16 of base structure 12 as shown. Flanges 54*a*, 54*b* extend generally perpendicular to the respective wall portions 52 on both sides of shroud 50 to give the shroud its effective outer dimension. When the shroud 50 is positioned in place as shown in FIG. 1, the rearmost flange 54*a* is flush against wall surface 32 and the forwardmost flange 54*b* is flush against collar structure 40. As illustrated in FIG. 2, once the shroud 50 is in place, the station 10 appears to be a surface mounted structure which has been properly installed, because the distance D that collar 40 stands off from side wall 16 is reduced. That is the effective side wall of base structure 12 is changed, and is increased. The bottom section of side wall 16 is not covered by shroud 50, because the bottom wall will not generally be seen by an adult when the station is mounted to the wall.

FIG. 3A illustrates the baby changing station moved to the open position and shows the actuation of the cylinder 60 coupled between the support platform 18 and base structure 12 which is discussed further hereinbelow. A securement stop or lip 62 is coupled to the base structure, such as by a weld (not shown). Stop or lip 62 extends along a substantial portion of the length of base structure 12 and preferably along the entire length of base structure 12. As seen in FIG. 3A, the lip is configured and positioned on the base structure 12 so as to catch a rear edge 64 of the support platform 18 when the platform is moved to the open position. In that way, the platform is secured in the open position and the support platform is prevented from being overextended. The elongated lip also prevents an exposed gap between the base structure 12 and support platform 18 to eliminate the possibility of diapers, pacifiers, lotion bottles, toys or other implements from falling therein. Lip 62 maintains a support platform 18 in a generally horizontal position for receiving a baby thereon. Furthermore, the downwardly extending lip section 63 and the engagement with rear edge 64 provides a safety precaution which prevents overhinging the support platform 18. Station 10 of the invention thereby provides a safe and secure support platform 18 for receiving the baby which will be able to withstand a large amount of weight without collapsing. Lip 62 is also preferably formed of stainless steel and the steel-on-steel engagement between lip 62 and support platform 18 further enhances the safety of station 10.

The strong steel-on-steel construction of the lip 62 and base structure 12 provides a station that is extremely durable and damage-proof. The station of the invention is able to withstand a substantial amount of use from high traffic applications such as in amusement park restrooms. The durability of the station also allows safe support for the baby even if the station has withstood a lot of use or vandalism.

As is illustrated in FIG. 3B, lip 62 extends forwardly from base structure 12 so as not to interfere with support platform 18 when it is moved to a closed position. FIG. 3B illustrates the support platform 18 without the insulative bed 24 therein. However, if an insulative bed 24 was positioned within the support platform 18, it is preferable that sufficient space be provided within a support platform for allowing the platform to close completely. As illustrated in FIG. 1, the top most surface of bed 24 rests below the top edge 17 of the support platform to provide sufficient clearance for lip 62.

The support platform 18 includes an angled wall 77 proximate a bottom rear edge of the platform. The angled wall 77 provides for close placement of the hinge axis to the bottom of the base structure 12 to reduce unsightly gaps along the bottom of the closed station. Referring to FIG. 3B, the lower rear corner of the platform 18, if squared at the corner, would contact the base structure 12 and would be prevented from closing. The close the support platform, the hinge axis would have to be raised, which would leave a large gap between the platform and base structure. The present invention eliminates the unsightly gap while providing a generally aesthetically pleasing station when closed. Furthermore, since the axis 20 is maintained lower in the base structure, the support platform may be made with a suitable width and depth without having to substantially raise or deepen the base structure 12.

Station 10 further comprises a pressurized cylinder 60 which is coupled between the support platform 18 and the base structure 12. More specifically, pressurized cylinder 60 includes a cylinder body 66 which includes a piston inside the cylinder, and an extensible cylinder piston rod 67 which is rigidly attached to the piston. The cylinder 60 is preferably pneumatically or fluidly pressurized so that the cylinder 60 has a rest or steady state length and any compression of the piston rod 67 and the body 66 will provide a bias on the piston in the cylinder to return it to the steady state length. The cylinder is operable such that an extension of piston rod 67 from the body 66 will provide a dampening effect similar to a shock absorber. The upper end 68 of the cylinder is coupled to the base structure 12 at a position above the support platform 18. End 68 is rotatably coupled to base structure 12 such as by opposing flanges 69 and a hinge pin 70 extending therethrough to rotatably secure end 68. End 72 of the cylinder 67 is similarly rotatably mounted to support platform 18 by opposing flanges 73 and a hinge pin 74.

As illustrated in FIGS. 3A and 3B, the location of flanges 73 and end 72 and thus the point of connection of cylinder 60 to the support platform is located rearwardly of the hinge axis 20 of the support platform 18. In that way, cylinder 60 facilitates the opening and closing of the support platform 18 and dampens the support platform so that it does not slam open and biases the support platform so that it may be easily closed when the diaper changing procedure is complete. A handle 79 is formed by an indentation in the bottom of the support platform 18 to facilitate opening and closing of the platform.

More specifically, as illustrated in FIG. 3B, when the support platform 18 is moved to the closed position, the piston rod 67 is withdrawn from the cylinder body 66 to a length longer than the steady state of the cylinder. When the support platform 18 is then moved to the opened positioned as illustrated in FIG. 3B, it hinges on axis 20 and the connection point is moved inwardly and upwardly as shown in FIG. 3A by reference numeral 75. Cylinder 60 provides a dampening force on the support platform and keeps it from slamming open. When the support platform 18 is in the completely opened positioned, the cylinder piston rod 67 is compressed into body 66 to shorten the effective length of cylinder 60 with respect to its steady state length. Cylinder 60 is operable, when compressed, to provide a bias on piston rod 67 to return it to its steady state position. That is, cylinder 60 exerts a closing force on the support platform 18 by directing the cylinder force to the connection point located rearwardly of pivot axis 20. That is, cylinder 60 is operable to bias the support platform to rotate it clockwise around axis 20 to thereby return the support platform to the closed position.

As may be appreciated, a person having just changed a baby's diaper would generally be holding the baby, and also holding other implements such as a purse, diaper bag or a coat. Therefore, they will not have a substantial amount of strength available for closing the baby changing station. This might be a problem, and particularly so with the present invention which utilizes a support platform 18 formed of stainless steel and thus having a greater weight than the traditional molded plastic platform. However, support platform 18 of the invention may be easily manipulated between the open and close position to facilitate easier use of the station. As illustrated in FIG. 1, cylinder 60 may be enclosed within a casing 78 to thereby hide the cylinder from view. As may be appreciated, the insulative bed 24 would have to be appropriately formed with an indentation 31 to account for either the cylinder 60 or a cover 78 used thereon.

Returning to FIG. 3A, lip 62 is notched as indicated by reference line 65 to allow the cylinder piston rod 67 to move closer to the base structure 12 when the support platform is opened and the piston is moved rearwardly and upwardly. Baby diaper changing station 10 of the invention might also comprise tissue holders 80 which are configured to hold tissues therein and which are dimensioned so as not to interfere with support platform 18 when it is closed.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A wall-mounted station for changing the diapers of a baby comprising:

a base structure configured for mounting to a wall;

a support platform hingedly coupled to the base structure and movable alternatively between opened and closed positions, the support platform formed of stainless steel and configured to define a trough for receiving a baby placed on the platform when in the opened position;

an insulative surface of plastic material mounted within the trough for supporting a baby placed therein, the insulative surface being at least partially supported above a surface of said trough and for maintaining the baby generally out of contact with the stainless steel support platform during changing of the baby's diapers to generally keep the baby from being chilled by the stainless steel platform;

said partially supported insulative surface including a cylindrically curved portion which sinks into said trough for receiving and containing a baby placed on the insulative surface.

2. The baby diaper changing station of claim 1 wherein the insulative surface includes a utility tray formed therein for receiving and containing items used to change a baby's diapers.

3. The baby diaper changing station of claim 1 wherein the support platform and base structure are configured and dimensioned to nest together when in the closed position to reduce an effective thickness of the closed changing station when mounted on the wall.

4. The baby diaper changing station of claim 3 wherein the support platform is configured and dimensioned to nest inside of the base structure when moved to the closed position.

5. The baby diaper changing station of claim 1 wherein the base structure includes a bottom wall and a sidewall extending generally perpendicular to the bottom wall for being inset into a wall surface, the changing station further comprising a peripheral lip positioned around the sidewall and operable for engaging a wall surface when the base structure is inset therein to limit the depth of penetration of the base structure into the wall surface.

6. The baby diaper changing station of claim 5 further comprising a shroud configured for being coupled to the base structure to cover an outer surface portion of the base structure sidewall generally from the bottom wall to the peripheral lip.

7. The baby diaper changing station of claim 1, wherein said insulative surface comprises an insulative bed supported within the trough.

8. A wall-mounted station for changing the diapers of a baby comprising:

a base structure configured for mounting to a wall;

a support platform formed of stainless steel and hingedly coupled to the base structure, the support platform defining a trough movable alternatively between a closed position and an opened position generally perpendicular to the base structure for receiving a baby placed on the platform;

the support platform including a rear edge positioned proximate the base structure when the support platform is in an opened position;

a stop coupled to the base structure and extending forwardly thereof when the base structure is mounted to a wall, the stop engaging a portion of the support platform rear edge when the platform is opened to secure the platform in the opened position;

an insulative surface of plastic material mounted within the trough and being at least partially supported above a surface of said trough for maintaining a baby generally out of contact with the stainless steel support platform;

the insulative surface including a cylindrically curved portion which sinks into said trough for receiving and containing a baby placed on the insulative surface.

9. The baby diaper changing station of claim 8 wherein the base structure is formed of stainless steel and the stop is anchored to the base structure.

10. The baby diaper changing station of claim 8 wherein the base structure includes a bottom wall and a sidewall extending generally perpendicular to the bottom wall for being inset into a wall surface, the changing station further comprising a peripheral lip positioned around the sidewall and operable for engaging a wall surface when the base structure is inset therein to limit the depth of penetration of the base structure into the wall surface.

11. The baby diaper changing station of claim 10 further comprising a shroud configured for being coupled to the base structure to cover an outer surface portion of the base structure sidewall generally from the bottom wall to the peripheral lip.

12. The baby diaper changing station of claim 8 wherein the support platform and base structure are configured and dimensioned to nest together when in the closed position to reduce an effective thickness of the closed changing station when mounted on the wall.

13. The baby diaper changing station of claim 12 wherein the support platform is configured and dimensioned to nest inside of the base structure when moved to the closed position.

14. The baby diaper changing station of claim 8 wherein the support platform is box shaped and includes an angled wall proximate said rear edge, the angled wall providing clearance from the base structure when the support platform is closed.

* * * * *